US007967303B2

(12) United States Patent
Miller

(10) Patent No.: US 7,967,303 B2
(45) Date of Patent: Jun. 28, 2011

(54) CARRIAGE SYSTEM FOR A WATER VESSEL

(76) Inventor: Henry Ed Miller, Englewood, CO (US)

( * ) Notice: Subject to any disclaimer, the term of this patent is extended or adjusted under 35 U.S.C. 154(b) by 223 days.

(21) Appl. No.: 12/465,188

(22) Filed: May 13, 2009

(65) Prior Publication Data

US 2010/0289235 A1 Nov. 18, 2010

(51) Int. Cl.
*B62B 1/00* (2006.01)

(52) U.S. Cl. ..... 280/47.331

(58) Field of Classification Search ..... 280/47.331, 280/47.34, 47.371

See application file for complete search history.

(56) References Cited

U.S. PATENT DOCUMENTS 3,135,975 A * 6/1964 Andranigian ..... 114/344
4,036,507 A 7/1977 Henderson
4,300,252 A * 11/1981 Montooth ..... 280/414.2
4,567,844 A * 2/1986 Johnson ..... 114/344
6,446,569 B1 9/2002 Pitts
6,662,743 B1 12/2003 Rolfe
7,296,816 B2 11/2007 Wilnau

* cited by examiner

*Primary Examiner* — Faye M. Fleming
(74) *Attorney, Agent, or Firm* — Jerry D. Haynes; Law Office of Jerry D. Haynes

(57) ABSTRACT

Disclosed is a carriage system for a water vessel. The carriage system comprises a support assembly and a wheel assembly. The support assembly is removably attached to a first side of the water vessel. The support assembly comprises a first body member disposed on an inner surface of the first side, and a handle member removably attached to the first body member. The wheel assembly is removably attached to a second side opposite to the first side of the water vessel. The wheel assembly comprises a second body member disposed on an inner surface of the second side, and a wheel member removably attached to the second body member. The support assembly facilitates pulling of the water vessel. Further, the wheel assembly facilitates movement of the water vessel upon being pulled using the support assembly.

5 Claims, 6 Drawing Sheets

CARRIAGE SYSTEM FOR A WATER VESSEL

FIELD OF THE DISCLOSURE

The present disclosure relates generally to carriage systems, and, more particularly, to a carriage system for a water vessel capable of moving the water vessel from one place to other.

BACKGROUND OF THE DISCLOSURE

Water vessels such as a boat, a kayak, a canoe, and the like, are used for short distance transportation and also for recreational purposes. The water vessels are capable of floating on bodies of water such as a river, a lake, a sea, and the like. Transportation of a water vessel from a place of storage of the water vessel to a body of water and vice versa has always been a concern for a user. The user may port the water vessel from the place of storage of the water vessel to the body of water. However, transporting the water vessel may be difficult and tiresome, given the weight of the water vessel and the potential distance involved. Various transportation means such as dollies, trailers, wagons, hand trucks, wheeled platforms, and the like, are known in the art, which are employed for transportation of the water vessel from one place to the other. However, such transportation means are helpful only for transporting the water vessel to distant places. Further, such transportation means may only be used for transportation of the water vessel to a vicinity of the body of water and thereafter, the user may have to carry the water vessel up to the body of water. Furthermore, use of such transportation means is cumbersome and may incur considerable cost to the user.

Accordingly, there exists a need for a carriage system for a water vessel capable of moving the water vessel from one place to other. Further, there exists a need for a carriage system for a water vessel, which is cost effective, user-friendly and saves time.

SUMMARY OF THE DISCLOSURE

In view of the foregoing disadvantages inherent in the prior art, the general purpose of the present disclosure is to provide a carriage system for a water vessel configured to include all the advantages of the prior art, and to overcome the drawbacks inherent therein.

Therefore, an object of the present disclosure is to provide a carriage system for a water vessel capable of moving the water vessel from one place to other in a more efficient manner.

Another object of the present disclosure is to provide a carriage system for a water vessel, which is cost effective, user-friendly and saves time.

To achieve the above objects, in an aspect of the present disclosure, a carriage system for a water vessel is provided. The carriage system comprises a support assembly and a wheel assembly. The support assembly is removably attached to a first side of the water vessel. The support assembly comprises a first body member disposed on an inner surface of the first side, and a handle member removably attached to the first body member. The handle member extends from an outer surface of the first side of the water vessel. The wheel assembly is removably attached to a second side opposite to the first side of the water vessel. The wheel assembly comprises a second body member disposed on an inner surface of the second side, and a wheel member removably attached to the second body member. The wheel member extends from an outer surface of the second side of the water vessel. Further, the water vessel is supported on the wheel assembly and the support assembly is capable of moving the water vessel on the wheel assembly from one place to the other.

This together with other aspects of the present disclosure, along with the various features of novelty that characterize the present disclosure, is pointed out with particularity in the claims annexed hereto and form a part of this present disclosure. For a better understanding of the present disclosure, its operating advantages, and the specific objects attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in structure and design. It should be emphasized, however, that the present disclosure is not limited to a particular carriage system, as shown and described. It is understood that various omissions and substitutions of equivalents are contemplated as circumstances may suggest or render expedient, but these are intended to cover the application or implementation without departing from the spirit or scope of the claims of the present disclosure.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

Figure 1A:
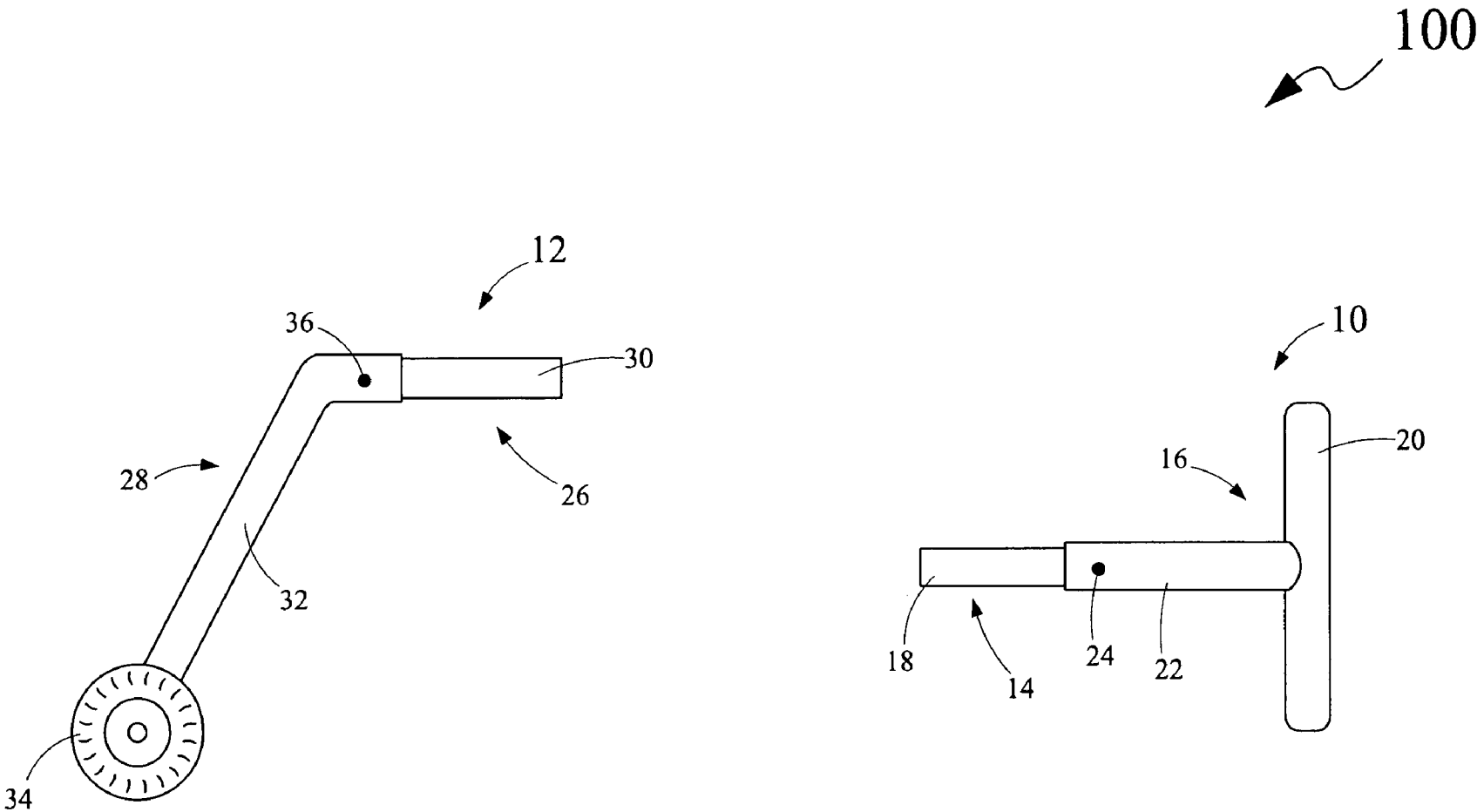
FIG. 1A illustrates a side view of a carriage system for a water vessel, in accordance with an embodiment of the present disclosure.
Figure 1B:
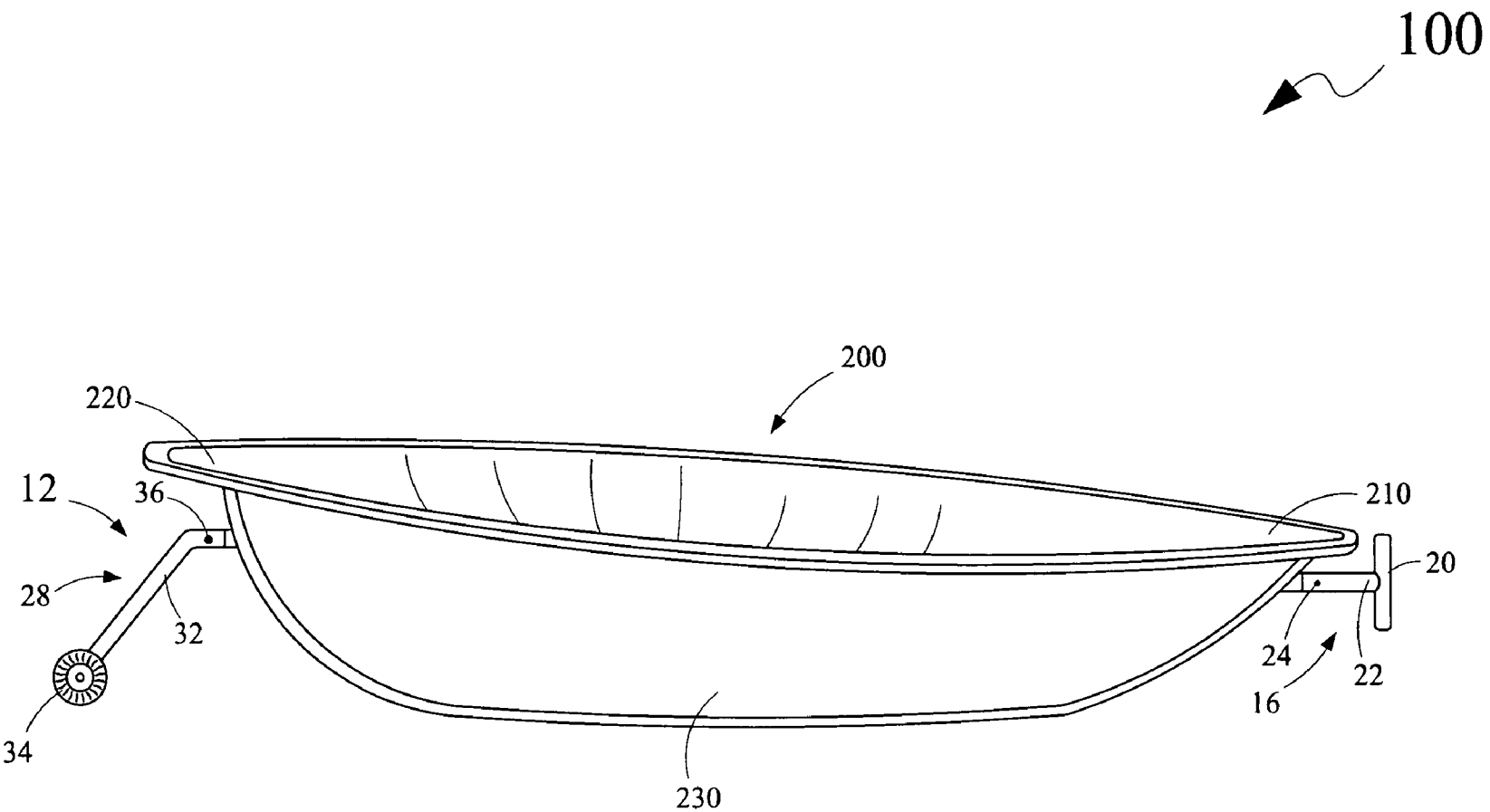
FIG. 1B illustrates a side view of the carriage system disposed on a water vessel, in accordance with an embodiment of the present disclosure.

FIG. 1A illustrates a side view of a carriage system 100, in accordance with an embodiment of the present disclosure. FIG. 1B illustrates the carriage system 100 removably attached to a water vessel, such as a water vessel 200. The water vessel such as the water vessel 200, may include a boat, a kayak, a canoe, and the like, which is capable of short distance transportation and also capable of being used for recreational purposes. The water vessel 200 includes a first side 210, a second side 220 and a base 230. The carriage system 100 includes a support assembly 10 removably attached to the first side 210 of the water vessel 200 as shown in FIG. 2 and a wheel assembly 12 removably attached to the second side 220 opposite to the first side 210 of the water vessel 200 as shown in FIG. 3.

Figure 2:
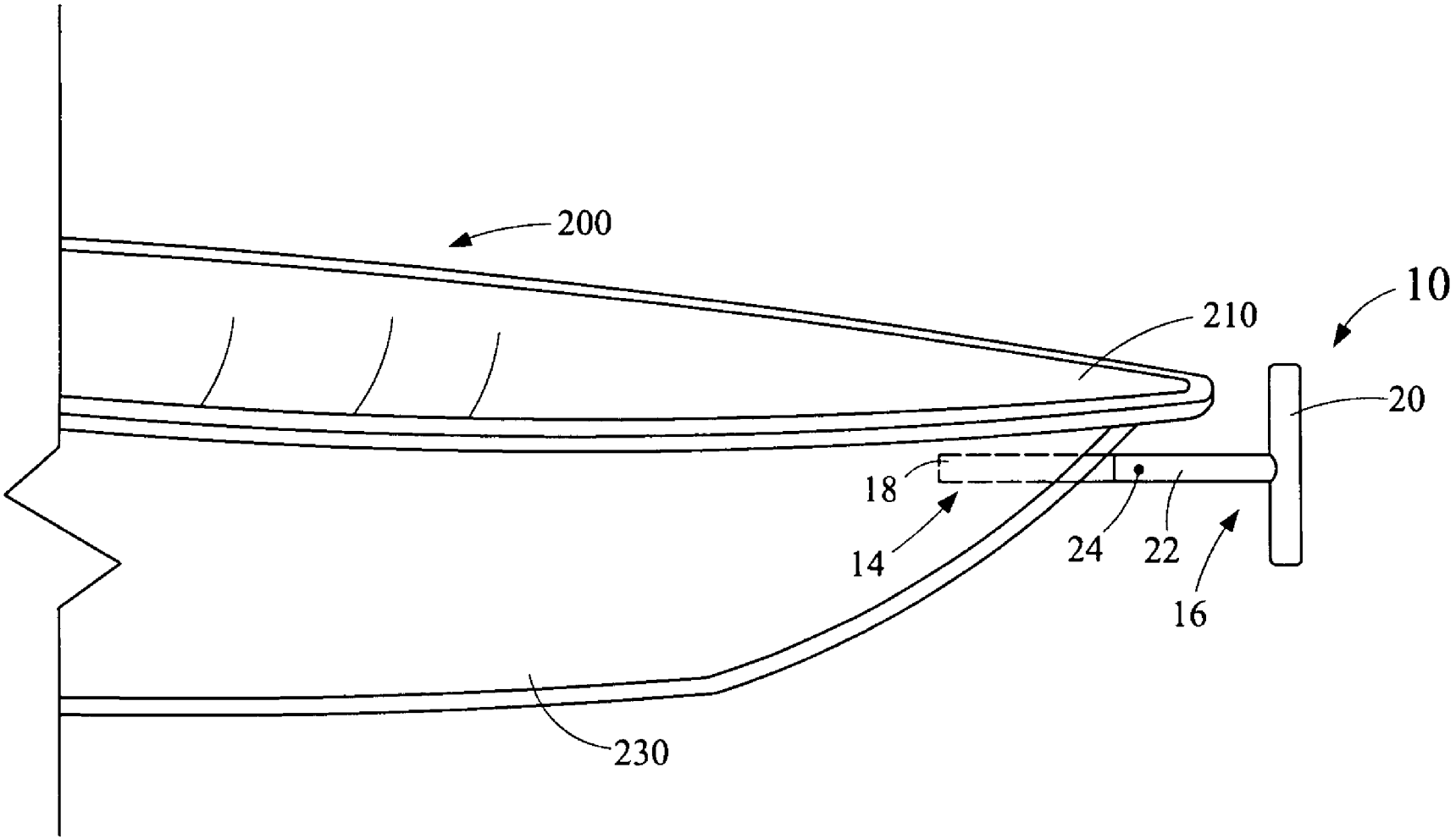
FIG. 2 illustrates a side view of a support assembly of the carriage system of FIG. 1A.

FIG. 2 illustrates a side view of the support assembly 10 removably attached to the first side 210 of the water vessel 200. As shown in FIGS. 1A and 2, the support assembly 10 includes a first body member 14 disposed on an inner surface (not numbered) of the first side 210 of the water vessel 200 and a handle member 16 extending from an outer surface (not numbered) of the first side 210 of the water vessel 200. The handle member 16 is removably attached to the first body member 14. The handle member 16 may be removably attached with the first body member 14 through the first side 210 of the water vessel 200 by various means known in the art. For example, an opening (not shown) may be drilled in the first side 210 of the water vessel 200 extending from the inner surface to the outer surface of the first side 210 to accommodate the first body member 14 and to allow the coupling of the first body member 14 and the handle member 16.

Further, the first body member 14 includes a first end portion 18 and a second end portion (not shown). The handle member 16 includes a gripping portion 20 and an elongated portion 22. The handle member 16 is capable of removably attaching with the second end portion by various coupling means known in the art. For example, the elongated portion 22 of the handle member 16 may be attached to the first body member 14 by a snap fit arrangement in a manner such that the elongated portion 22 of the handle member 16 may slide and fit on the second end portion of the first body member 14. Further, the handle member 16 may be detached from the second end portion of the first body member 14 by a push button such as a push button 24. It will be apparent to those skilled in the art that appearance and structural configuration of the support assembly 10 is set forth herein for purposes of illustration only and that the present disclosure is not limited to either the described appearance or the described structural configuration of the support assembly 10.

Figure 3:
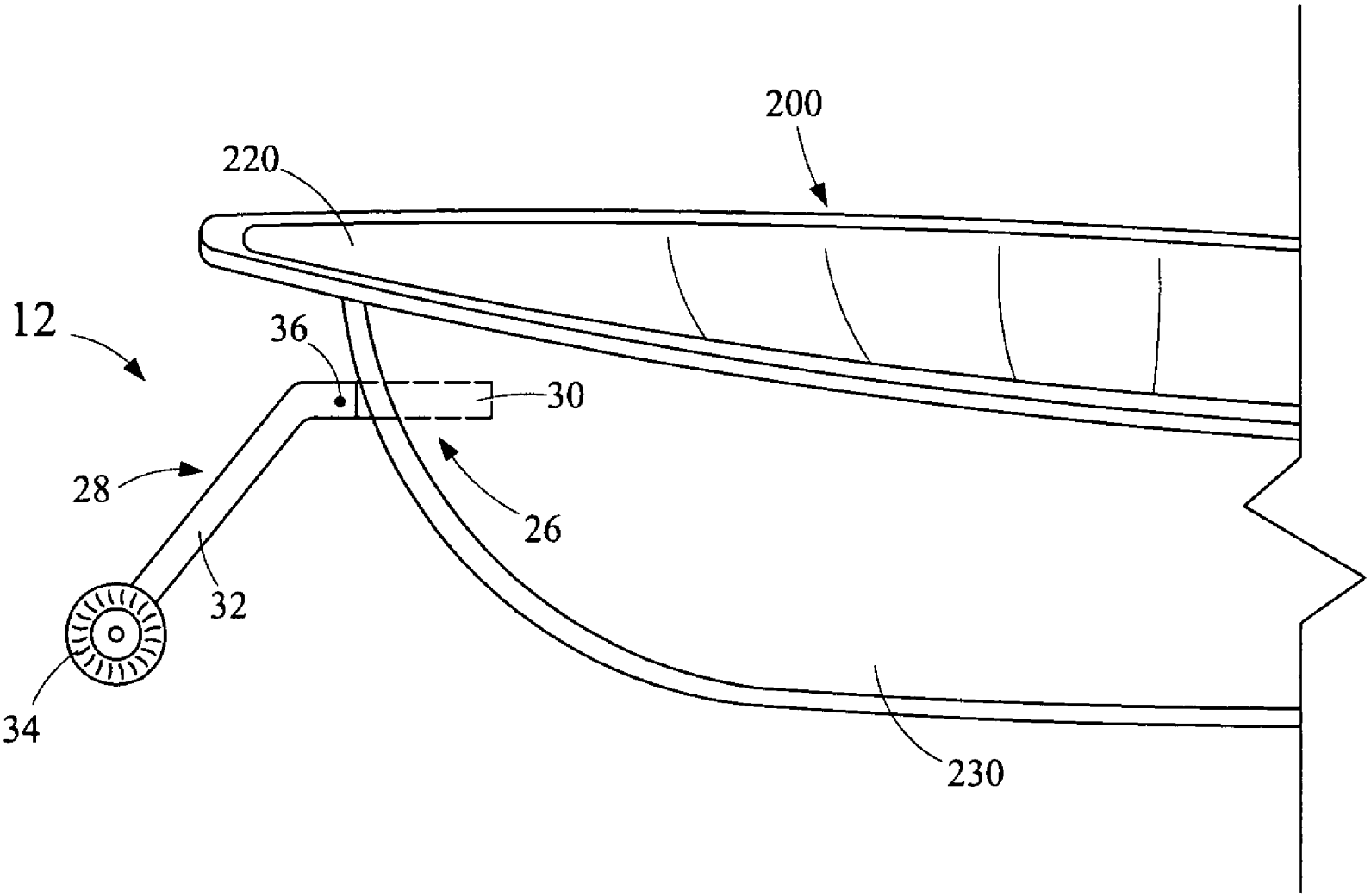
FIG. 3 illustrates a side view of a wheel assembly of the carriage system of FIG. 1A.

FIG. 3 illustrates a side view of the wheel assembly 12 removably attached to the second side 220 of the water vessel 200. As shown in FIGS. 1A and 3, the wheel assembly 12 includes a second body member 26 disposed on an inner surface of the second side 220 of the water vessel 200 and a wheel member 28 extending from an outer surface of the second side 220 of the water vessel 200. Further, the wheel member 28 is removably attached to the second body member 26 on an outer surface of the second side 220 of the water vessel 200. The wheel member 28 may be removably attached with the second body member 26 through the second side 220 of the water vessel 200 by various means known in the art. For example, an opening (not shown) may be drilled in the second side 220 of the water vessel 200 extending from the inner surface to the outer surface of the second side 220 to accommodate the second body member 26 and to allow the coupling of the second body member 26 and the wheel member 28.

Further, the second body member 26 includes a first end portion 30 and a second end portion (not shown). The wheel member 28 includes a leg portion 32 and a plurality of wheels, such as a wheel 34. The leg portion 32 of the second body member 26 is capable of removably attaching with the second end portion of the wheel member 28 by various means known in the art. For example, the wheel member 28 may be attached to the second body member 26 by a snap fit arrangement in a manner such that the leg portion 32 of the wheel member 28 may slide and fit on the second end portion of the second body member 26. Further, the leg portion 32 of the wheel member 28 may be detached from the second end portion of the second body member 26 by a push button such as a push button 36. It will be apparent to those skilled in the art that appearance and structural configuration of the wheel assembly 12 is set forth herein for purposes of illustration only and that the present disclosure is not limited to either the described appearance or the described structural configuration of the wheel assembly 12.

Figure 4:
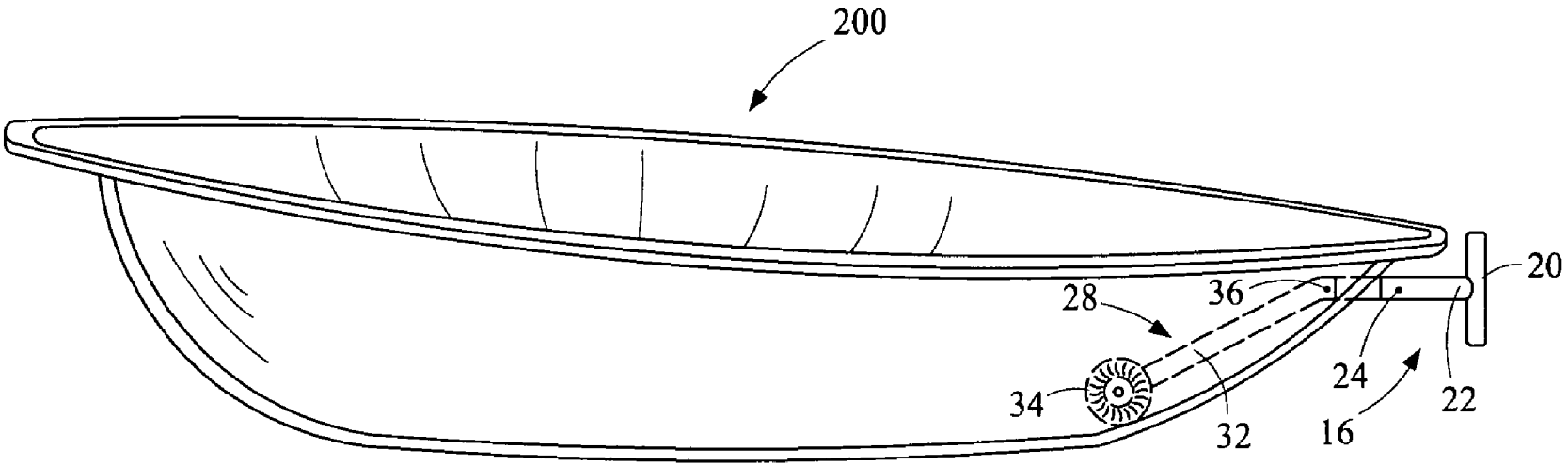
FIG. 4 illustrates a side view of a wheel member of a wheel assembly stored in a water vessel, in accordance with an exemplary embodiment of the present disclosure.

Furthermore, the wheel member 28 is capable of being stored within the water vessel 200, during non-use of the wheel member 28. The non-use of the wheel member 28 may include examples such as during the use of the water vessel 200 on the body of water, and the like. FIG. 4 illustrates a side view of the wheel member 28 stored in the water vessel 200, in accordance with an exemplary embodiment of the present disclosure. The wheel member 28 is capable of being removably attached with the second end portion of the first body member 14 or the second end portion of the second body member 26 during non-use of the wheel member 28. Similarly, the handle member 16 is capable of being removably attached with the second end portion of the first body member 14 or the second end portion of the second body member 26 during non-use of the wheel member 28. Removable attachment of the wheel member 28 and the handle member 16 inside the water vessel 200 provides for easy storage of the wheel member 28 and the handle member 16 inside the water vessel 200.

The first body member 14 of the support assembly 10 may have a cuboidal shape, cubical shape, and the like. The elongated portion 22 of the handle member 16 may be a hollow structure with a shape corresponding to the shape of the first body member 14 such that the handle member 16 easily slides and fits over the second end portion of the first body member 14. In an embodiment of the present disclosure, the first body member 14 of the support assembly 10 may be a hollow structure capable of accommodating the elongated portion 22 of the handle member 16. Similarly, the second body member 26 of the wheel assembly 12 may have a cuboidal shape, cubical shape, and the like. Further, the leg portion 32 of the wheel member 28 may be a hollow structure with a shape corresponding to the shape of the second body member 26 such that the wheel member 28 easily slides and fits over the second end portion of the second body member 26. In an embodiment of the present disclosure, the second body member 26 of the wheel assembly 12 may be a hollow structure capable of accommodating the leg portion 32 of the wheel member 28. The gripping portion 20 of the handle member 16 may have different shapes and sizes depending upon the preference of the user, such as a T-shaped gripping portion, a ring shaped gripping portion, and the like. Furthermore, the support assembly 10 and the wheel assembly 12 are made of a lightweight sturdy material such as a metal, aluminum, a plastic, and the like. It will be evident to a person skilled in the art that the shape, size and material of construction of the support assembly 10 and the wheel assembly 12 is set forth herein for purposes of illustration only and may not be construed as limiting.

Figure 5:
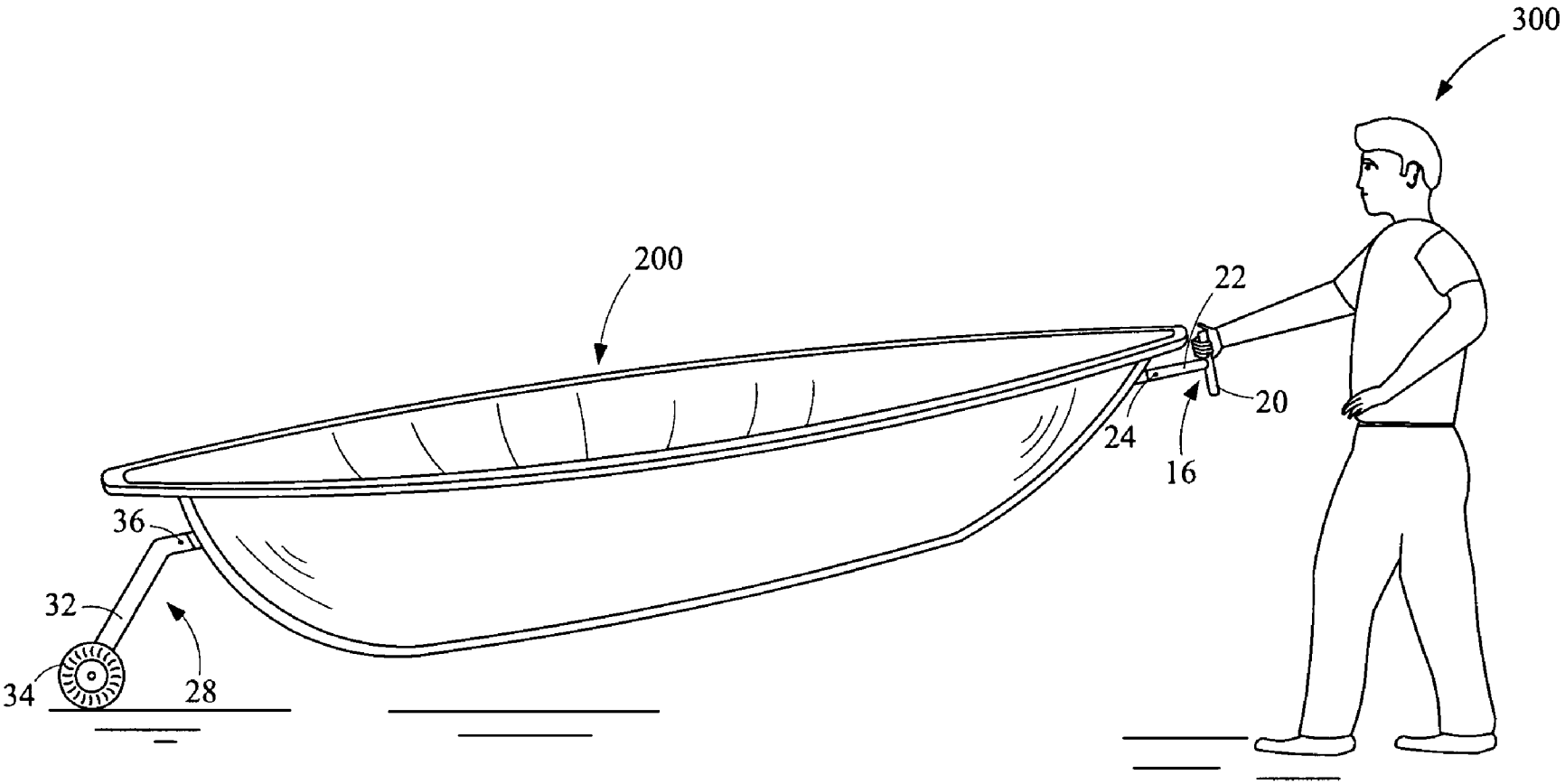
FIG. 5 illustrates a side view of a carriage system in use, in accordance with an exemplary embodiment of the present disclosure.

In use, the support assembly 10 is removably attached on the first side 210 of the water vessel 200 and the wheel assembly 12 is removably attached on the second side 220 of the water vessel 200. More specifically, the elongated portion 22 of the handle member 16 may be attached to the first body member 14 by a snap fit arrangement in a manner such that the elongated portion 22 of the handle member 16 slides and fits on the second end portion of the first body member 14. Similarly, the wheel member 28 may be attached to the second body member 26 by a snap fit arrangement in a manner such that the leg portion 32 of the wheel member 28 slides and fits on the second end portion of the second body member 26. Once the support assembly 10 and the wheel assembly 12 have been configured on the water vessel 200, the water vessel 200 is capable of being pulled from one place to the other. More specifically, a user, such as a user 300 as shown in FIG. 5, may hold the gripping portion 20 of the handle member 16 in a manner such that the water vessel 200 is lifted from ground and supported on the plurality of wheels of the wheel assembly 12. After the water vessel 200 has been supported on the plurality of wheels of the wheel assembly 12, the water vessel 200 is capable of being moved from one place to the other by pulling the handle member 16. On pulling the handle member 16 of the support assembly 10, the water vessel 200 may be moved on the plurality of wheels of the wheel assembly 12. Further, the carriage system 100 may be stored within the water vessel 200, when not in use. More specifically, the wheel member 28 may be detached from the second end portion of the second body member 26 by a push button such as the push button 36. Thereafter, the wheel member 28 may be removably attached with the first end portion 30 of the second body member 26 of the wheel assembly 12 or the first end portion 18 of the first body member 14.

It will be evident to a person skilled in the art that the support assembly 10 and the wheel assembly 12 of the carriage system 100 may have multitude of sizes and structural configuration and the present embodiment as explained herein in conjunction with FIG. 1 to FIG. 5 is set forth for purposes of illustration only and may not be construed as limiting. The carriage system 100 may have different sizes in order to be accommodated on the water vessels of various sizes and shapes.

The present disclosure provides a carriage system, such as the carriage system 100 for a water vessel such as the water vessel 200, which offers the following advantages. The carriage system is capable of moving a water vessel from one place to other in a more efficient manner. The carriage system for the water vessel is cost-effective, user-friendly and saves time. The carriage system for the water vessel precludes the need of employing various transportation means such as dollies, trailers, wagons, hand trucks, wheeled platforms, and the like, for transporting the water vessel from one place to the other on land.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present disclosure.

What is claimed is:

1. A carriage system for a water vessel, the carriage system comprising:

a support assembly removably attached to a first side of the water vessel, the support assembly comprising a first body member disposed on an inner surface of the first side, and a handle member removably attached to the first body member and extending from an outer surface of the first side of the water vessel; and a wheel assembly removably attached to a second side opposite to the first side of the water vessel, the wheel assembly comprising a second body member disposed on an inner surface of the second side, and a wheel member removably attached to the second body member and extending from an outer surface of the second side of the water vessel, wherein the support assembly facilitates pulling of the water vessel, and wherein the wheel assembly facilitates movement of the water vessel upon being pulled using the support assembly.

2. The carriage system of claim 1, wherein the handle member comprises an elongated portion, and a gripping portion attached to the elongated portion.

3. The carriage system of claim 1, wherein the wheel assembly comprises a leg portion, and a plurality of wheels attached to the leg portion.

4. The carriage system of claim 1, wherein the handle member is removably attached with the first body member by a snap fit arrangement.

5. The carriage system of claim 1, wherein the wheel member is removably attached with the second body member by a snap fit arrangement.

* * * * *